United States Patent [19]

Fara

[11] 4,363,288

[45] Dec. 14, 1982

[54] DEVICE FOR APPLYING A COATING LAYER TO A STRIP OF CONTINUOUSLY MOVING MATERIAL

[75] Inventor: Jacques P. Fara, Le Vesinet, France

[73] Assignee: D.C.M., Rueil Malmaison, France

[21] Appl. No.: 247,937

[22] Filed: Mar. 26, 1981

[30] Foreign Application Priority Data

Apr. 16, 1980 [FR] France ..... 80 08553

[51] Int. Cl.[3] ..... B05C 1/00; B41F 1/46; B41F 31/00

[52] U.S. Cl. ..... 118/210; 101/350; 101/363; 118/249; 118/262

[58] Field of Search ..... 118/210, 249, 262; 101/350, 349, 363, 148

[56] References Cited

U.S. PATENT DOCUMENTS 3,769,909 11/1973 Fugman et al. ..... 101/363 X
4,237,785 12/1980 Dahlgren ..... 101/363 X

FOREIGN PATENT DOCUMENTS 2916212 10/1980 Fed. Rep. of Germany ..... 101/350

*Primary Examiner*—Michael R. Lusignan
*Attorney, Agent, or Firm*—Lane, Aitken, Kice & Kananen

[57] ABSTRACT

The coating device of the invention, which enables a layer of product to be deposited on a strip (1) travelling between two rotary cylinders (2, 3), is characterized in that it comprises a reserve (8) containing the coating product; a first roller (9) associated with the reserve for continuously taking therefrom a specific amount of coating product; a second roller (10) bearing against one of the rotary cylinders (3, 2), the first and second rollers being parallel and spaced from each other; a third loosely mounted roller (11), bearing on the first and second rollers; means ($M_1$) for rotating the first roller and imparting thereto a constant preadjusted speed; and means ($M_2$) for rotating the second roller and imparting thereto a speed equal to the travelling speed of the strip, the first and second rollers rotating in the same direction .

6 Claims, 1 Drawing Figure

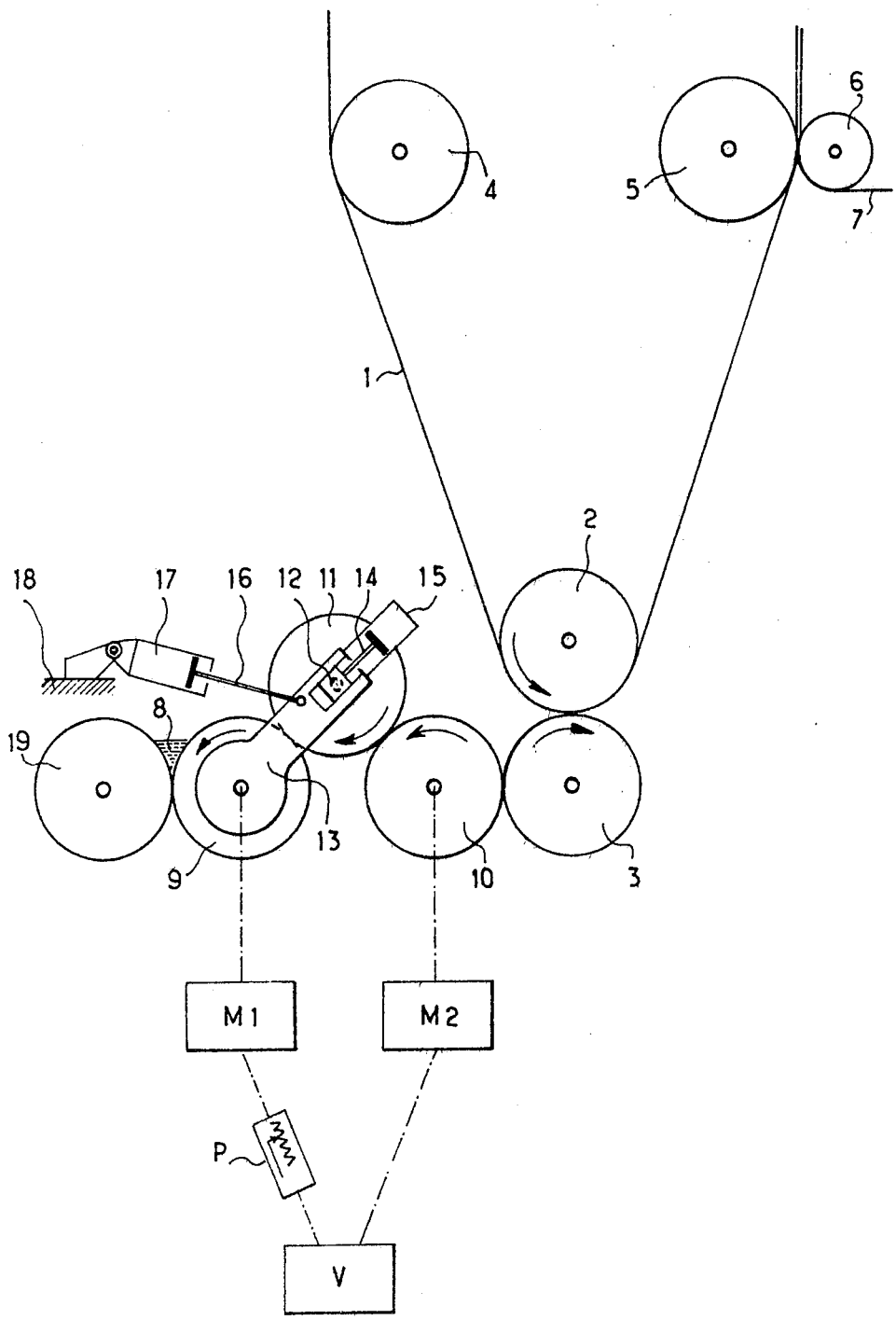
1
2
3
4
5
6
7
8
9
10
11
12
13
14
15
16
17
18
19
M1
M2
P
V

DEVICE FOR APPLYING A COATING LAYER TO A STRIP OF CONTINUOUSLY MOVING MATERIAL

The present invention relates to a device for continuously applying a coating layer on a strip of material travelling between two rotary cylinders bearing one against the other and whose speed of rotation is equal to the travelling speed of the strip.

Present coating devices are designed to deposit relatively thick layers of liquid or slightly viscous products on very varied strip materials. They are for example often used for applying adhesives diluted in solvents on strips of paper, cellulose, plastic material or aluminium. They do not however give satisfaction when the products to be applied have a high viscosity and must be deposited in the form of a film of small thickness. In fact, viscous products such as adhesives without solvents cannot be deposited thereby, especially when the maximum thickness of the film formed with these products must be for example between 0.4 and 5 g/m$^2$.

The present invention proposes remedying these disadvantages and, for this, it provides a coating device which is characterized in that it comprises a reserve containing the coating product; a first roller associated with the reserve for continuously taking therefrom a specific amount of coating product; a second roller bearing against one of the rotary cylinders, the first and second rollers being parallel and spaced apart from each other; a third loosely mounted roller, bearing on the first and second rollers; means for rotating the first roller and transmitting thereto a constant preadjusted speed; and means for rotating the second roller and transmitting thereto a speed equal to the travelling speed of the strip, the first and second rollers rotating in the same direction.

During operation of the coating device, the first roller continuously takes from the reserve a constant amount of product which it feeds to the third roller. This latter then carries along with it the product which it receives from the first roller and feeds it to the second roller. In its turn, the second roller carries along the product which it receives from the third roller and feeds it to the cylinder which applies it to one of the faces of the moving strip.

Since the first and second rollers are rotated by different drive means, the layer of the product deposited by the third roller on the second will be all the thinner since this latter will rotate faster than the first roller. By suitably adjusting the speed of the first roller it is then possible to give to the thickness of the layer of the product transferred to the second roller, and consequently to the strip, a constant value which may be very small.

Advantageously the coating device in accordance with the invention further comprises means for adjusting the pressure of the third roller on the first and second rollers. This other arrangement provides an even more accurate adjustment of the thickness and evenness of the layer of coating product deposited on the strip. By suitably adjusting the intensity of the pressure with which the third roller bears on the first and second rollers, it is in fact possible to modify the amount of product able to be transferred from the first to the second roller and so to control with greater accuracy the thickness and the evenness of the layer deposited in the strip.

According to a preferred embodiment of the invention, the third roller is supported at each of its ends by bearings mounted on levers pivoting on the shaft of the first roller, each bearing being radially movable with respect to the first roller under the action of a first pneumatic piston-and-cylinder means, whereas each level is able to pivot about the shaft of the first roller under the action of a second pneumatic piston-and-cylinder means.

The pneumatic piston-and-cylinder means of course allow the pressure exerted by the third roller on the other two to be accurately adjusted.

In some cases, it is furthermore advantageous for one at least of the rollers to comprise heating means. In fact, when the coating product is very viscous, it is thus possible to lower its viscosity so that its application to the strip may be effected under the best conditions. Tests have shown that it is desirable to bring the viscosity of the product down to about 2500 centipoises.

Preferably, the third roller has a length equal to the width of the strip and is shorter than the other two rollers whose length corresponds to that of the cylinders feeding the material to be coated.

The coating product is thus applied on the second roller only over a length equal to the width of the strip. It follows that the operations for maintaining or cleaning the second roller and cylinder which bears thereagainst become thus easier.

It will be noted here that by providing third rollers of different lengths, it is possible to coat strips of any width with the same coating device.

According to a particular embodimemt, the reserve of product extends between the first roller and a roller secured against rotation and applied against this latter by adjustable clamping means. By suitably adjusting the clamping pressure exerted between the fixed roller and the first roller, the flow rate of the coating product taken from the reserve may of course be controlled.

An embodiment of the present invention will be described hereafter by way of example, which is in no wise limiting, with reference to the accompanying drawing in which the single FIGURE is a schematical side view of the coating device in accordance with the invention.

The coating device which can be seen in the FIGURE allows a layer of product, for example an adhesive without solvent, to be applied to a strip of material 1 travelling at a constant speed between two cylinders 2 and 3 which bear against one another and whose speed of rotation is equal to the travelling speed of the strip. The strip 1, whose tension is adjusted in a way known per se, passes over a drive cylinder 4 situated upstream of cylinder 2 and between two powered cylinders 5 and 6 situated downstream of cylinder 2 and at which another strip of material 7 is applied against the coated face of strip 1.

In accordance with the invention, the coating device comprises a reserve 8 containing the coating product, a first roller 9 associated with the reserve 8 for taking continuously therefrom a specific amount of product, a second roller 10 bearing against roller 3 and spaced from roller 9, and a third loosely mounted roller 8, bearing against rollers 9 and 10. A DC motor $M_1$, which is connected to a source not shown by means of a current variator V and a potentiometer P, is provided for driving roller 9 at a constant preadjusted speed of rotation. A second DC motor $M_2$, fed through variator V, drives roller 10 at a constant speed of rotation equal to the travelling speed of strip 1.

It will be readily understood that with potentiometer P it is possible to modify the speed of roller 9 and so to change the ratio of the speeds of rollers 9 and 10.

In the example shown, the loosely mounted roller 11 is supported at each of its ends by bearings 12 mounted on levers 13 pivoted to the shaft of roller 9. Each bearing 12 is connected to the rod 14 of a pneumatic piston-and-cylinder device 15 carried by the corresponding lever 13 and may then move radially with respect to roller 9 when the piston-and-cylinder device 15 is actuated. It is evident that actuation of the piston-and-cylinder devices 15 enables the pressure of roller 11 against roller 9 to be adjusted.

Furthermore, each lever 13 is pivoted to the free end of the rod 16 of another pneumatic piston-and-cylinder device 17 whose body is pivoted to the frame 18 of the coating device. Thus, by suitably actuating the piston-and-cylinder devices 17, it is possible to adjust the pressure of roller 11 on roller 10.

It should be noted here that it would be possible to provide another embodiment in which levers 13 are pivoted not to the shaft of roller 9 but to the shaft of roller 10.

The reserve of product 8 is defined laterally by roller 9 and a roller 19 secured against rotation against roller 9 by adjustable clamping means not shown. To facilitate cleaning of roller 19 and for compensating the wear thereof, this roller 19 is preferably mounted on free wheels by means of which it may be easily brought into another fixed position.

According to a particularly advantageous arrangement, one at least of rollers 9, 10 and 11 is furthermore provided with heating means such as internal passages for the flow of a heat-carrying fluid. Thus, when the product to be deposited on strip 1 is particularly viscous, it is possible to lower its viscosity to an ideal point for use, which is situated approximately close to 2500 centipoises. By adjusting the temperature of the heat-carrying fluid, the coating device in accordance with the invention allows then products to be applied whose viscosities may be adjusted to the same value during treatment.

For the sake of completeness, it will be noted that roller 11 has a length equal to the width of strip 1 but is shorter than rollers 9 and 10 which are as long as cylinders 2 and 3.

It will also be noted that roller 19 is preferably made from "Hypalon", whereas roller 9 is made from chrome steel, roller 11 is made from elastomer, roller 10 is rubber-covered, cylinder 3 is made from steel and cylinder 2 is rubber-covered.

With the coating device of the invention, it is possible to deposit on strips of very varied materials, a very thin coating layer, even when the product to be deposited has a high viscosity. It is in fact sufficient to suitably adjust the rotational speed of roller 9 with respect to that of roller 10 and to judiciously adjust the pressure which roller 11 exerts on rollers 9 and 10.

By way of example, there will be given below the different operating parameters which were chosen for depositing on a strip of paper an adhesive without solvent having a viscosity of 133 poises at 20° C. and forming a film with a thickness of 0.9 g/m$^2$.

Speed of rotation of roller 10 (equal to the travelling speed of the strip): 150 m/min.

Speed of rotation of roller 9: 15 m/min.

Pressure exerted between rollers 9 and 10: 4 bars.

Pressure exerted between rollers 9 and 11: 2.5 bars.

Pressure exerted between rollers 10 and 11: 2 bars.

Pressure exerted between roller 10 and cylinder 3: 4 bars.

Pressure exerted between cylinders 2 and 3: 4 bars.

Temperature of roller 9 in which flows a heat-carrying fluid: 35° C.

The coating device in accordance with the invention may be used for depositing a layer of product on strips of different widths. It is in fact sufficient to provide it with a roller 11 whose length is equal to the width of the strip to be coated. It may furthermore operate satisfactorily whatever the travelling speed of strip 1. In this case, all that is required is to adjust variator V so that motor $M_2$ drives roller 10 at a speed of rotation equal to the travelling speed and to adjust potentiometer P to give to the ratio of the rotational speeds of rollers 9 and 10 a constant determined value.

Depending on the thickness and the nature of the coating layer to be deposited, it is of course desirable to adjust the ratio of the speeds of rollers 9 and 10, to adjust the pressure exerted by roller 11 on rollers 9 and 10, and to bring the heat-carrying fluid to a temperature at which the viscosity of the coating product may take on the value the most suitable for the coating.

The coating device which has just been described is more particularly intended for applying a layer of a product such as an adhesive without solvent on a strip travelling between two cylinders bearing one against the other. It is however evident that it is not limited to this particular application and that it could also be used in the case where the coating product is an ink and where the strip of material is formed by a plate mounted on cylinder 2.

I claim:

1. A device for continuously applying a coating layer on a strip of material travelling between two rotary cylinders bearing one against the other and having a rotational speed equal to the travelling speed of the strip, one of said rotary cylinders being an applicator cylinder applying the coating layer to the strip, comprising:

a reserve containing a coating product, a take-up roller controlled in rotation for continuously taking from the reserve a specific amount of product, means for transferring the product taken by the take-up roller to said applicator cylinder, the transfer means including a second roller (10) situated between and extending parallel to the take-up roller (9) and the applicator cylinder (3) and bearing only against the applicator cylinder, and a third roller (11) bearing against the take-up roller and the second roller, first means for rotating the take-up roller at a constant preadjusted speed of rotation, and second means for rotating the second roller (10) in the same direction as the take-up roller, at a speed equal to the travelling speed of the strip (1), the third roller (11) being loosely mounted.

2. The device as claimed in claim 1, further comprising means (15, 17) for adjusting the pressure of the third roller (11) on the take-up roller and the second roller.

3. The device as claimed in claim 2, characterized in that the third roller (11) is supported at each of its ends by bearings (12) bearing on levers (13) pivoted on the shaft of the take-up roller (9), each bearing being radially movable with respect to the take-up roller (9) under the action of a first pneumatic piston-and-cylinder means (15), whereas each lever is capable of pivoting about the shaft of the take-up roller under the action of a second pneumatic piston-and-cylinder means (17).

4. The device as claimed in claim 1 characterized in that one at least of the rollers includes heating means.

5. The device as claimed in claim 1 characterized in that the third roller (11) has a length equal to the width of the strip (1) and is shorter than the other two rollers (9, 10) whose length corresponds to that of the cylinders (2, 3).

6. The device as claimed in claim 1 characterized in that the reserve of product (8) extends between the take-up roller (9) and a roller (19) secured against rotation and applied thereagainst by adjustable clamping means.

* * * * *